US005678982A

United States Patent [19]

Schwaiger

[11] Patent Number: 5,678,982

[45] Date of Patent: Oct. 21, 1997

[54] PORTABLE HYDRAULIC SYSTEM

[75] Inventor: Heinz Schwaiger, Eching, Germany

[73] Assignee: Weber-Hydraulik GmbH, Losenstein, Austria

[21] Appl. No.: 507,608

[22] Filed: Jul. 26, 1995

[30] Foreign Application Priority Data

Jul. 27, 1994 [DE] Germany ..... 9412147 U

[51] Int. Cl.[6] ..... F04B 49/06

[52] U.S. Cl. ..... 417/44.2; 417/63; 60/486

[58] Field of Search ..... 417/17, 44.2, 63; 60/458, 477, 478, 486, 494

[56] References Cited

U.S. PATENT DOCUMENTS

| | | | |
|---|---|---|---|
| 4,009,971 | 3/1977 | Krohn et al. | 417/43 |
| 4,050,835 | 9/1977 | Womack | 408/11 |
| 4,211,080 | 7/1980 | White | 60/458 |
| 4,218,885 | 8/1980 | White | 60/456 |
| 4,218,886 | 8/1980 | White | 60/486 |
| 4,278,050 | 7/1981 | Kime | 122/39 |
| 4,341,017 | 7/1982 | Janczak | 30/381 |
| 4,623,124 | 11/1986 | Lewis | 254/350 |
| 4,906,906 | 3/1990 | Lautzenhiser et al. | 318/269 |
| 4,978,899 | 12/1990 | Lautzenhiser et al. | 318/269 |
| 5,012,165 | 4/1991 | Lautzenhiser et al. | 318/53 |
| 5,111,681 | 5/1992 | Yasui et al. | 72/453.03 |
| 5,113,679 | 5/1992 | Ferraro et al. | 72/21 |
| 5,125,158 | 6/1992 | Casebolt et al. | 30/228 |
| 5,152,162 | 10/1992 | Ferraro et al. | 72/20 |
| 5,195,042 | 3/1993 | Ferraro et al. | 364/468 |
| 5,195,354 | 3/1993 | Yasui et al. | 72/453.03 |
| 5,272,811 | 12/1993 | Armand | 30/228 |
| 5,423,654 | 6/1995 | Rohrbaugh | 414/686 |

FOREIGN PATENT DOCUMENTS

| | | |
|---|---|---|
| 3835696 A1 | 4/1990 | Germany . |
| 3835696 C2 | 12/1993 | Germany . |

OTHER PUBLICATIONS

NTIS TechNotes, Mar., 1992, pp. 161–162, "Portable Hydraulic Power Source".

*Primary Examiner*—Timothy Thorpe
*Assistant Examiner*—Xuan M. Thai
*Attorney, Agent, or Firm*—Graybeal Jackson Haley LLP

[57] ABSTRACT

Disclosed is a mobile hydraulic system with a hydraulic pump, which is powered by a battery powered motor and fed from a hydraulic reservoir, whereby the pump, the battery, the motor and the hydraulic reservoir are a compact, portable hydraulic unit, to which a working tool, which is separated from the portable hydraulic unit and is exchangeable, can be connected via a hydraulic connecting line of the hydraulic pump.

17 Claims, 3 Drawing Sheets

FIG. 1
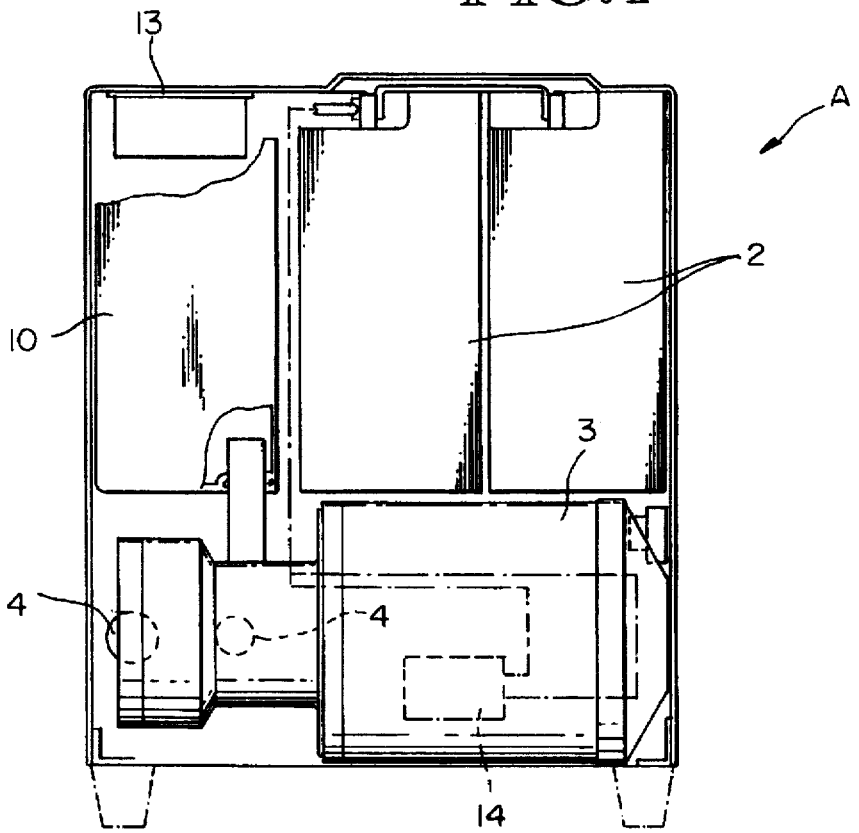
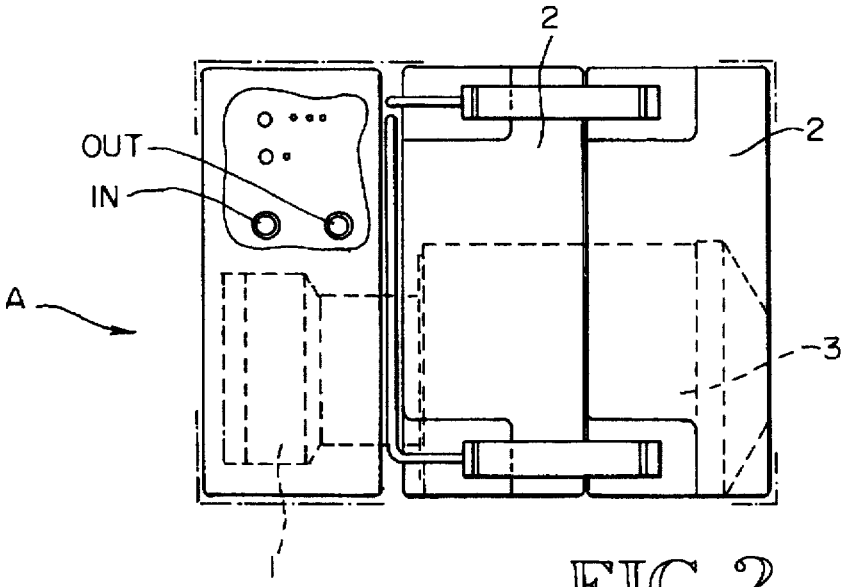
FIG. 2

PORTABLE HYDRAULIC SYSTEM

BACKGROUND OF THE INVENTION

This invention relates to a mobile hydraulic system for working tools such as crushers and clamps or rescue vehicles such as cutting tools.

There are other hydraulic systems that offer the use of crushers at building sites or make it possible to use hydraulic tools at the site of an accident.

In use are hydraulic systems where the electric motor is dependent on an electrical supply system, to which the electric motor is connected, that feeds the hydraulic pump from the hydraulic reservoir. The mobility of such a system is limited due to its external supply of electric power and for instance has therefore restrictive use for rescue equipment. Also these electric driven pump assemblies are running constantly, and are only slowed down with the help of an overload valve in periods of non-use. Therefore, the propulsion power is converted into thermal energy. These pumps consume a lot of electrical energy.

Also in use are hydraulic pumps which are driven by an internal combustions engine. Yet due to the use of fuel and/or lubricants, these are cumbersome in it's application. For example, these hydraulic systems cannot be operated or only with difficulty, in a slanted or overhead position as they are emitting unwanted noise and harmful emissions.

In addition you find in existence hydraulic systems where the electric motor is connected to a battery and is driving the hydraulic pump. But the battery, the hydraulic pump and the working tool are three separate entities, making the handling of such a system somewhat complicated.

SUMMARY OF THE INVENTION

The intend of this invention was to create a mobile hydraulic system which is light and simple to operate.

The basic tasks of this invention is described in claim 1. Additional advantageous details are defined in sub-claims.

The invention describes a hydraulic system where the pump, the motor, the battery and the hydraulic tank are combined in a compact, portable hydraulic system. The working tool is separated from the hydraulic system and both entities are easy to transport. Since both parts are separate entities, the working tool can be used or employed separately from the hydraulic system and be kept in the right working position, whereas the hydraulic system can be placed away from the working tool. Being able to connect the working tool to another hydraulic system is an additional advantage. In this case, the invented hydraulic supply system is to be considered as an addition only, to achieve a high degree of mobility.

The hydraulic system can be a single hose or dual hose system. A single hose system serves only as a single connection between the hydraulic system and the working tool, which contains the forward and reverse hydraulic fluid flow. The dual hose system separates the connections for the forward and reverse flow.

The hydraulic reservoir can be built as an open reservoir as well as a low pressure accumulator. A spring—or gas pressured piston or diaphragm accumulator permits operation in any position since the batteries can also be placed in any position.

In conformity with additional developments, the hydraulic system incorporates an indicator to show the charging condition of the battery. This way a prediction can be made before or during use how much more the system can be utilized.

An additional advantage is a switching mechanism that disconnects the motor during times of non-use and therefore saves on energy coming from the batteries. It is especially advantageous to mount the disconnect switch directly to the working tool, so it can be directly operated.

Alternatively, in addition to the disconnect switch, it is possible to have an additional control system incorporated which allows the control and lowering of motor speed during periods of non-use.

In an additional advantageous arrangement of the hydraulic system, the operation does not have to depend entirely on battery power, it can be backed up and assisted with power from the battery charger. This way, in an assumed stationary application in a workshop a continuous operation can be achieved.

BRIEF DESCRIPTION OF THE DRAWINGS

This invention will be explained on hand of preferred application examples in reference to the drawings.

FIG. 1 is a front view of a hydraulic unit of a mobile hydraulic system.

FIG. 2 is a top view of a hydraulic unit from FIG. 1.

DETAIL DESCRIPTION OF THE INVENTION

Figure 3:
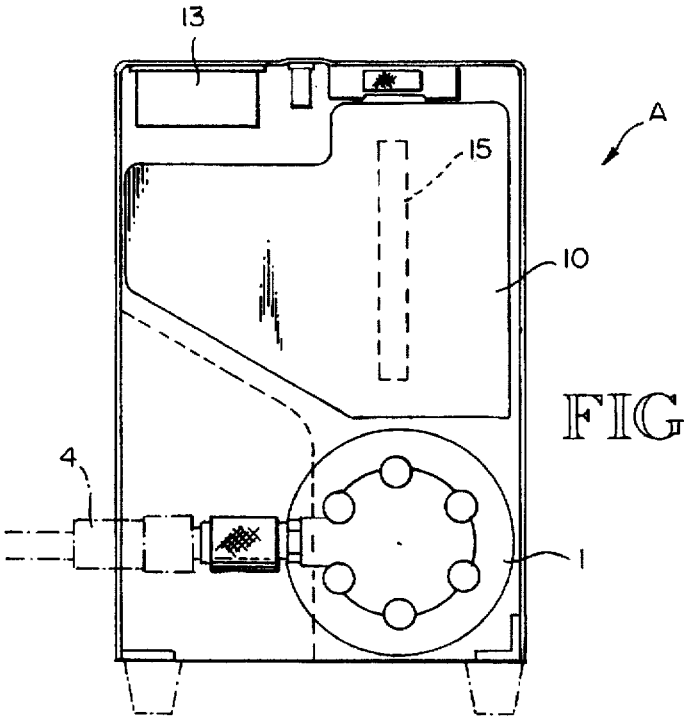
FIG. 3 is a side view of the hydraulic unit from FIG. 1.

With reference to FIGS. 1, 2 and 3 following is a description of the built-up of a hydraulic pump assembly.

According to FIG. 1 the hydraulic unit A consists of a housing which contains a hydraulic pump (1), an electric motor (3), two batteries (2) and a hydraulic reservoir (10). The hydraulic unit A is of compact design and portable. In the demonstrated example the hydraulic unit is cubical in shape. The two batteries (2) are placed side by side and the hydraulic reservoir (10) is located next to them on one side. The hydraulic unit, consisting of the motor (3) and the hydraulic pump (1) is located under the batteries (2) and the hydraulic reservoir (10). The enclosure in which the hydraulic unit A will be housed is to be built of a strong metal and is supported by legs on the underside at all four corners. In a mobile environment the hydraulic unit A can be supported by these legs. The housing could as well be built of plastic material with sufficient strength or other suitable materials.

The hydraulic unit A is completely enclosed to protect the parts from damage in the mobile environment. As shown in FIG. 3, the housing has an opening, shown as -.- line, that will allow connection with the hydraulic pump (1) by means of a hydraulic connecting line (4). The hydraulic connecting line (4) will supply the working tools with pressurized hydraulic fluid. The hydraulic connecting line (4) can either be connected directly to the appointed terminal of the hydraulic pump (1) or via a short integrated connecting line (which in turn will be connected to the connecting line (4)). As explained below, depending on the executed example, either one hydraulic connecting line(4) or two hydraulic connecting lines (one forward, one reverse) are envisioned for the working tool (5).

Instead of the housing detailed in FIGS. 1,2 and 3 the hydraulic unit A can be suitably designed for a back pack operation, so it may be carried by a person. The batteries (2) can also be aligned on top of each other. While the pump system in FIG. 1 is shown in horizontal position, the motor (3) and the hydraulic pump (1) can be installed vertically as well. The stability of the hydraulic unit can be improved by placing the battery (2) in the bottom.

The two batteries (2) should preferably be lead type batteries of 17 and 28 AH. Both batteries can be electrically parallel connected to increase the capacity, or in series to increase the voltage. The number of batteries (2) can be changed in discretionary fashion. Only one battery (2) might be needed if, for instance, the power demand is low, while for a higher power demand the number of batteries (2) will be chosen accordingly. In addition to the lead type batteries, NiCd batteries or Nitti batteries can be used. Advantageous are all batteries which can be used in all possible positions.

The hydraulic reservoir (10), which is placed above the hydraulic pump (1), feeds this pump (1) through a connecting line, and can be refilled through a fill connection which can be locked up and is located on the top side of the hydraulic reservoir. It is accessible from the outside of the housing. The hydraulic reservoir (10) can be an open reservoir as well, whereby in this case the hydraulic pump (1) must be designed for self priming. An open reservoir is preferred when different working tools (5) are connected, to ensure that a sufficient amount of hydraulic fluid is available since working tools (5) have a great difference in storing hydraulic fluids. The hydraulic reservoir (10) can also be designed as a low pressure accumulator, leading to a closed circuit system, like for instance in the form of a piston accumulator or as spring—or gas membrane pressure accumulator.

As mentioned in FIG. 3, a liquid level gauge (15) of the hydraulic reservoir (10) is shown. This liquid level gauge (15) is located in a recess in a side wall of the housing of the hydraulic unit A and is visible from the outside. Therefore the liquid level of the hydraulic reservoir (10) can always be controlled. The liquid level gauge (15) can be equipped with a scale, indicating the required amount of hydraulic fluid which must be added to the hydraulic reservoir through the fill connection.

An indicator (13) is located on the inside of the upper closing wall of the housing of the hydraulic unit A which shows the charging condition of the battery (2) and sends a signal to an optical indicator. In the displayed application example this optical indicator consists of three different color diodes. An additional red diode is used as an indicator for a protective switch (14), which will be discussed in a later chapter. Additionally, a momentary contact push button is located on top, but below the top side of the housing of the indicator (13). The battery charge indicator (13) is operated with the momentary contact push button and can be read through the multi-colored diodes.

The functioning mode of the battery charge indicator (13) is as follows: in the state of rest, when the motor (3) is not running, a control of the battery voltage is undertaken by operating the momentary contact push button. Through operation of the push button the battery voltage is compared by using a test resistance (I-10 characteristic line) with reference voltage of a built in IC. Depending on the value of the voltage, for instance charging condition of the battery (2), a green, yellow or red diode of the optical indicator is activated. When the connected battery voltage is in the nominal voltage range, the green diode is activated. Is the connected battery voltage under 90% the yellow diode is activated. Should the voltage continue to drop during operation then the red diode will be activated, thus indicating when the battery needs to be recharged.

One test to check the overall battery (2) condition under heavy loading can be accomplished through an external tester, that can be connected to an electrical connection which is not depicted in this write-up. Principally the described tester consists of a resister, which controls the magnitude of the current and a controller with an electronic measuring system. The switching of the current is accomplished through a relay of a protective switching system (14). Through the use of a momentary contact push button in the tester, the relay will be closed and kept closed for approx. 30 seconds. During this time the voltage drop is being measured and the end value will be indicated. Important are the load resistance, the duration of time .and the voltage end value. If needed graphical representations of the test results can be made.

As shown in FIG. 1, a protective switching system (14) is envisioned and located as shown, whose function will be explained. The protective switching system (14) is to protect the batteries (2) and the motor (3) through low voltage. When a load is connected a permanent voltage control is connected. After reaching a selective increased voltage level and a time delay of a approximately 3 seconds an acoustical signal will be generated. After reaching a continuous low voltage level and again after a time delay of 3 seconds an existing relay devise will operate the low voltage protection device and thereby disconnect the battery (2) from the motor (3). This disconnect mode remains even after switching the motor (3) off and the low voltage protection relay remains in open position and requires a separate reset operation. The reset operation can be accomplished through a momentary contact push button as well as through an automatic low voltage protection device, that is incorporated in the battery charging of the battery (2).

An additional battery operation, besides the exclusive battery operation, is possible with continuous charging from a battery charger. Again in this case the protective switching system (14) protects the motor (3) and the battery (2) from electrical damage.

In FIG. 2 an on- and off switch is incorporated which also can be used to connect or disconnect the hydraulic system. The switch is located on the top side of the housing.

Figure 4:
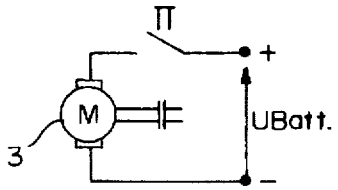
FIG. 4 is an electrical schematic of the hydraulic system in reference to a first application example.
Figure 5:
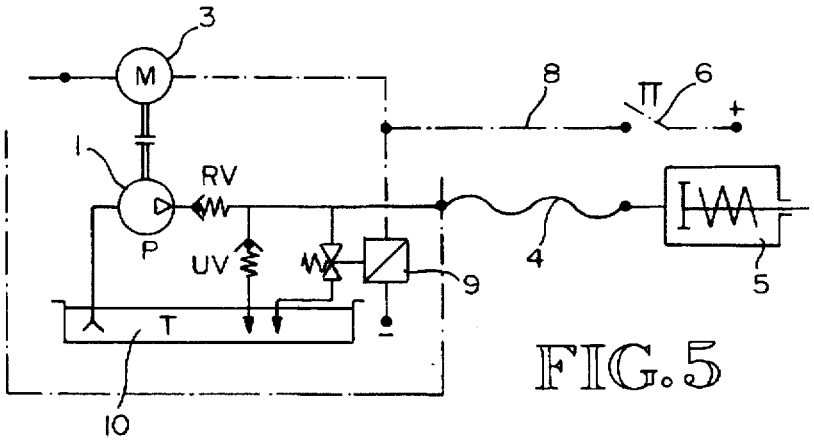
FIG. 5 is a schematic of an electrical and hydraulic circuit of the hydraulic system in reference to a first application example.

In reference to FIGS. 4 and 5, a single hose system is being described in reference to a first application example, which envisions only one connecting line between the hydraulic unit A The electric motor (3) in this case, as shown in FIG. 4, is connected to the minus- and plus poles of the battery (2). A main switch is located between the conductor run from the plus pole of the battery (2) to the electric motor (3).

According to FIG. 5, in a single hose application (4) with a working tool (5) an additional electrical connection (8) is made with the hydraulic unit A. A preferred method is to combine the electrical control wiring (8) with the hydraulic line (4). The electrical control wiring (8) contains a switch (6) on the working tool (5). When operating the switch (6) the electrical motor (3) is being connected or disconnected. The electrical motor (3) is connected to the hydraulic pump (1) with a shaft, which transports hydraulic fluid from the hydraulic reservoir (10) and pressurizes the hydraulic connecting line (4). The hydraulic connecting line (4) transfers the pressure to the connected working tool (5).

A check valve is located in the hydraulic connecting line (4) close to the hydraulic pump (1), in the direction of flow, to protect the hydraulic pump (1) against damage. In addition, in the direction of flow, a hydraulic relief valve UV is located in a branch line which is connected to the hydraulic connecting line (4) after the check valve RV, which limits and protects the hydraulic pressure to the working tool (5).

When with the help of the switch (6) the electrical supply to the motor (3) is disconnected, a bleed valve (9) opens at the same time. This bleed valve (9) is located in a bleed line which is placed in the direction of flow after the check valve RV and the line containing the hydraulic relief valve UV, but in front of the hydraulic connecting line (4). The bleed line reconnects, just as the pressure discharge line does, to the hydraulic reservoir (10). Through this the hydraulic connecting line (4) can be bled into the hydraulic reservoir (10) when the motor (3) is switched off. Now the working tool (5) and the hydraulic connecting line (4) can be separated without any danger. The bleed valve (9) incorporates solenoid, which is also deenergized when the electric supply is interrupted through operation of the switch (6). Through this a pressure spring can open the bleed valve (9).

With the help of switch (6), which is directly attached to the working tool (5), the motor (3) can be disconnected in times of no-use. Through this temporary disconnect of the motor (3) energy consumption is reduced and the battery (2) saved. The switch (6) can for instance be operated through a momentary contact push button, and by releasing the push button the electrical supply is immediately interrupted. This will prevent that an accidental connection with the working tool (5) through switch (6) is being left in the on position and starts the motor (3).

Instead or in addition to switch (6), which allows on- and off switching only, a continuous adjustment in the form of a potentiometer is envisioned, which is incorporated in working tool (5). A special feature in this case is the addition of a servo or proportional valve, in place of or in addition to the bleed valve (9), which is controlled through the potentiometer. With the help of this continuous adjustment, the forward and reverse flow in the hydraulic line (4) can be adjusted continually. Furthermore, instead of or in addition to this adjustment or the above mentioned switch (6), a needle valve with continuous orifice adjustment is envisioned on the working tool (5).

Figure 6:
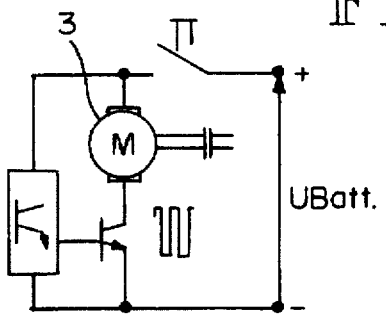
FIG. 6 is a schematic electrical circuit of the hydraulic system in reference to a second application example.
Figure 7:
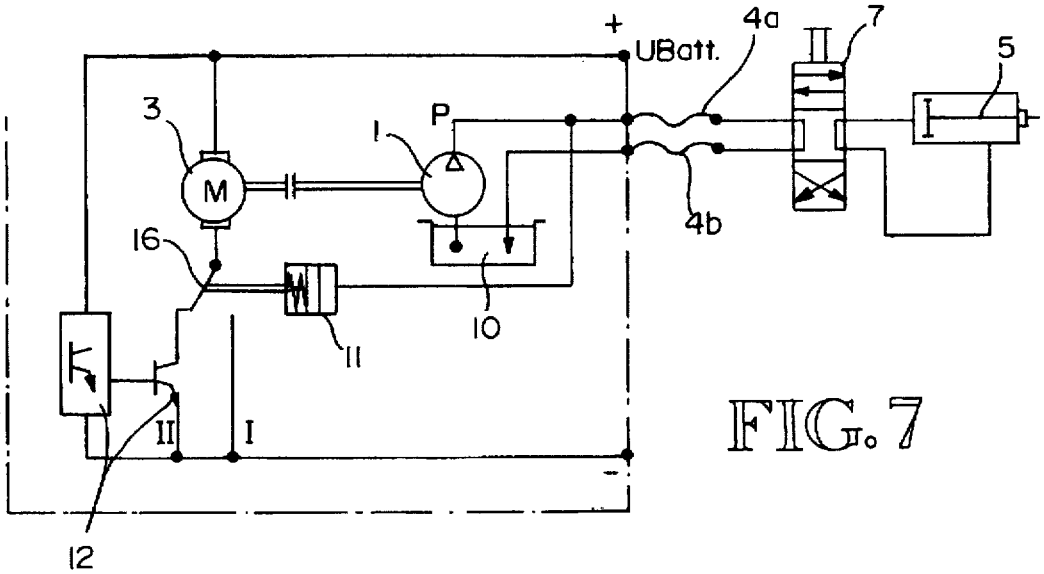
FIG. 7 is a schematic of an electrical and hydraulic circuit of the hydraulic system in reference to a second application example.
Figure 8:
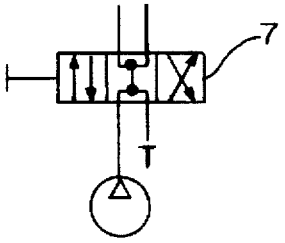
FIG. 8 is a schematic detailed drawing of an alternate hydraulic multi-port valve, which can be utilized in the hydraulic system shown in FIG. 7.

With reference to FIGS. 6, 7 and 8, a dual hose system according to a second application example is described, whereby the hydraulic connecting line (4) to the working tool (5) contains a hydraulic forward line (4*a*) and a hydraulic reverse line (4*b*).

FIG. 6 shows a schematic electrical circuit of the second application example. The electrical motor (3) is connected to the plus and minus poles of the battery (2). In the line which connects the plus pole with the electric motor (3) a main switch is envisioned similar to the first application example.

To reduce the nominal voltage to a no-load voltage, a voltage regulator (12) is being employed which is known. The voltage regulator (12) on its load side is equipped with a field effect transistor (FET) or a sensing –FET and works with puls width modulation. The transistor exit in this case provides direct current with constant voltage, but with interruption, i.e. with reduced turn-on time (pulse width). Because the frequency of the interruptions is relative high, the motor (3) is thereby sensing the interuptable DC current with constant voltage as a reduced voltage. The voltage regulator (12) can also be used simply to control the load depending on motor speed.

Additionally to the in FIG. 6 exhibited speed regulation for the no-load condition, which is depicted with current path I in FIG. 7, a second current path II for the load condition is envisioned. This way the electric motor (3) can be connected via an electric switch (16) directly with the minus pole of the battery (2). The electric switch (16) is connected with a pressure sensor (11) located in the hydraulic line (4*a*), which in turn operates the switch (16) mechanically when a predetermined pressure is exceeded and switches over to current path I.

A multi-port valve (7) is located on one side, between the forward and reverse hydraulic lines (4*a*) and (4*b*), and the working tool (5) on the other side. The multi-port valve (7) connects in its center position, which is depicted in FIG. 7, the hydraulic forward line (4*a*) direct with the hydraulic reverse line (4*b*), so that the pumped hydraulic fluid can return unobstructed to the reservoir (10). By shifting the hydraulic multi-port valve (7) in a first working position, the hydraulic forward line (4*a*) and the hydraulic return line (4*b*) are connected with the hydraulic working tool (5), extending the piston of work tool (5). Alternatively, when the hydraulic multi-port valve (7) is shifted, a second working position is established, and again connects the hydraulic forward line (4*a*) and the hydraulic reverse line (4*b*) with the hydraulic line of working tool (5), thereby retracting the piston of the working tool (5). In the in FIG. 8 exhibited center position of the hydraulic multi-port (7), the hydraulic forward line (4*a*) and the hydraulic reverse line (4*b*) will be directly connected to each other as well as the hydraulic forward and reverse lines of the working tool (5) to the lines (4*a* and 4*b*).

The second application example is described below: When the motor (3) is connected through the main switch, motor (3) will assume nominal speed via current path I and switch (16). After a time delay of voltage regulator (12), based on pressure conditions, the n nominal RPM is maintained when predetermined pressure conditions exist (for instance, operation of a working tool (5)), or the control will switch on stand-by insofar as the pressure conditions stay below a certain value. In this second case switch (16) will be connected via pressure sensor (11) into current path II. The no-load operation is for instance maintained when the hydraulic multi-port valve (7) remains in center position or when the working tool (5) has a low power demand.

If the multi-port valve (7) is shifted into the first or second working condition, it generates pressure immediately, which is sensed by the pressure sensor. With this the switch (16) will be switched through pressure sensor (11) into current path I to allow full battery voltage application to the motor (3). Because motor (3) has a high starting torc, no problems will occur by switching from no-load operation to full operational condition.

Because of thus, the batteries will operate on a low-current discharge characteristics curve when in idle condition. Internal resistance, like battery resistance, conductor resistance and contact resistance are considerably reduced compared to other discharge characteristic curves, so that the advantage of the switching system in the second application example is much more pronounced compared to a straight or simple power consumption between nominal RPM and idle RPM.

The controls of the first and second application example can be connected with each other in many combinations.

Especially the control system of the first application example, with variations and little adaptations, can be applied in the case of the second application example. It goes without saying that relieve valves and check valves con be envisioned in the second application example in the same method as in the first application example.

I claim:

1. A self-contained, mobile hydraulic system comprising:

a housing;

a hydraulic pump;

an electric motor linked to the pump;

a self-contained electricity source coupled to the pump;

a reservoir fluidly coupled to the pump; and a control system to vary the motor speed, wherein the control system comprises a first current path for use with load operations and a second current path for use with no-load operations whereby a control system switch selectively directs current to either the first current path or the second current path, and wherein the pump, the motor, the electricity source and the reservoir are secured to the housing.

2. The system of claim 1 wherein the reservoir has a biased accumulator.

3. The system of claim 1 wherein the reservoir is subject to ambient air pressure.

4. The system of claim 1 further comprising an indicator coupled to the electricity source for presenting to a user of the system the condition of the electricity source.

5. The system of claim 1 further comprising an indicator coupled to the reservoir for presenting to a user of the system the volume of fluid present therein.

6. The system of claim 1 further comprising a physically responsive electrical switch for selectively energizing and de-energizing the motor.

7. The system of claim 6 wherein the physically responsive electrical switch is adapted to locate on a working tool fluidly coupled to the system.

8. The system of claim 7 wherein the physically responsive electrical switch is used in conjunction with a fluid valve that relieves fluid pressure in the system.

9. The system of claim 1 wherein the control system switch is operatively coupled to the pump and actuated by fluid pressure generated by the pump.

10. The system of claim 9 further comprising a pressure sensor operatively coupled to the control system switch.

11. The system of claim 1 wherein the second current path comprises a voltage regulator.

12. The system of claim 11 wherein the second current path comprises a field effect transistor to provide pulse width modulated voltage to the motor.

13. The system of claim 1 wherein the housing is generally cubical.

14. The system of claim 1 wherein the housing is adapted for mounting on the back of a user.

15. The system of claim 1 wherein the self-contained electricity source is at least one electrical storage battery and wherein the system further comprises a battery charger coupled to the battery to permit recharging thereof from an external source.

16. A self-contained, mobile hydraulic system comprising:

a housing;

a hydraulic pump;

an electric motor linked to the pump;

a self-contained electricity source coupled to the pump;

a reservoir having a biased accumulator fluidly coupled to the pump;

a physically responsive electrical switch for selectively energizing and de-energizing the motor; and a control system to vary the motor speed having a control system switch operatively coupled to the pump and actuated by fluid pressure generated by the pump wherein the control system further has a first current path for use with load operations and a second current path for use with no-load operations whereby the control system switch selectively directs current to either the first current path or the second current path, and wherein the pump, the motor, the electricity source, the reservoir, and the control system are secured to the housing.

17. The system of claim 16 wherein the electricity source is a battery and further comprising a battery charge indicator coupled to the battery and a fluid level indicator coupled to the reservoir.

* * * * *